US006779974B2

(12) United States Patent
Chien

(10) Patent No.: US 6,779,974 B2
(45) Date of Patent: Aug. 24, 2004

(54) DEVICE OF A VOLUTE CHANNEL OF A PUMP

(75) Inventor: Huan-Jan Chien, Hsinchu (TW)

(73) Assignee: PolyVane Technology Corp., Hsinchu (TW)

( * ) Notice: Subject to any disclaimer, the term of this patent is extended or adjusted under 35 U.S.C. 154(b) by 82 days.

(21) Appl. No.: 10/316,035

(22) Filed: Dec. 11, 2002

(65) Prior Publication Data

US 2004/0115049 A1 Jun. 17, 2004

(51) Int. Cl.[7] ..... F01D 1/02
(52) U.S. Cl. ..... 415/206; 415/208.2; 415/211.2
(58) Field of Search ..... 415/206, 208.2, 415/204, 211.2, 212.1

(56) References Cited

U.S. PATENT DOCUMENTS 5,040,947 A * 8/1991 Kajiwara et al. ..... 415/206
5,069,599 A * 12/1991 Carretta ..... 415/182.1
5,127,800 A * 7/1992 Hyll et al. ..... 415/197
5,235,744 A * 8/1993 Arakawa et al. ..... 29/888.02
5,385,444 A * 1/1995 Kobayashi et al. ..... 415/182.1
6,200,090 B1 * 3/2001 Chien et al. ..... 415/172.1

* cited by examiner

*Primary Examiner*—Edward K. Look
*Assistant Examiner*—J. M. McAleenan
(74) *Attorney, Agent, or Firm*—Troxell Law Office PLLC

(57) ABSTRACT

A device of a volute channel of a pump is contained in a circular casing and cooperates a rotational impeller for pumping and delivering fluid. The device comprises a volute channel structure and a throat partition. The volute channel structure is a spiral volute channel and surrounds an impeller exit side. A leading edge of the volute channel is a water-cut angle. A sectional area of the volute channel is wider and deeper from the water-cut angle. An outer diameter of the volute channel is a concentric arrangement. The throat partition connects to a rear edge of the volute channel and extends toward an exit of the casing so as to that the throat partition is at least and mainly an extension of the volute channel; the extension of the volute channel overlaps the leading edge of the volute channel to have the total length of the volute channel, the total length is able to surround the impeller exit side over 360 degrees.

22 Claims, 11 Drawing Sheets

DEVICE OF A VOLUTE CHANNEL OF A PUMP

FIELD OF THE INVENTION

The invention relates to a device of a volute channel of a pump, especially the device cooperates with impellers to pumping fluid, and the total degree of volute channel surrounding the impellers is over 360 degrees.

BACKGROUND OF THE INVENTION

There are two casings for the design of the flow channel of pump, which are the volute casing and the diffuser casing, and both are to recovery the partially transferred pressure energy from the high kinetic energy outputted by impellers. The application theory of the volute casing is to use that the channel area is gradually increased, that is, the diffusing channel can slow down the velocity of fluid flow and recovery partial energy; the diffuser casing adopts the angles of the diffusers to recovery the tangential kinetic energy of the high-speed fluid flow from the diffusers. The two kinds of casings are capable of reaching high efficiency. Further, they can be usually seen in the normal pumps.

For small centrifugal pump, such as small self-priming pump, small centrifugal pump, small in-line pump, etc., whose design focuses on how to save the cost to manufacture products, but the efficiency is ignored. As an example, the small centrifugal pump traditionally adopts the concentric channel of the collect casing to satisfy the goal of easy manufacturing and saving cost. However, the cross-section area of the channel is always a certain value and without the water-cut angle to less the functions of diffusing channel at the channel exit and water-cut of the volute channel so as to let the flow diffusion at the exit of the channel, and the partial fluid return back in channel. When NPSHA at the inlet of the pump is lower down, the cavitations of liquid is then increased so as to that the channel be occupied the most space of the impeller channel, hence the function to deliver liquid is almost blocked to cause the performance of pumping is highly decreased. In some prior arts, adding diffuser structure and nozzle structure to such small centrifugal pump to increase the inlet head, by using the nozzle structure to return high-pressure liquid from pump outlet, and also for better mixing of liquid and gas; the mixture also enters into the impeller with higher speed to normally deliver liquid and increase pump efficiency when pump being under the condition of low NPSHA. However, it is to directly decreasing the performance and increasing the cost, and the dimensions of pump so as to not comply with the requirement of compact size at the present marketing.

There are several prior arts related to the technology of channel of pump casing, such as U.S. Pat. Nos. 5,040,946, 5,358,380, 5,310,310, 5,234,317, 5,385,444 and 5,318,403, wherein the U.S. Pat. Nos. 5,040,946, 5,358,380 and 5,310, 310 disclose the casing structure of the volute channel, which adopt to deform the outer diameter of the casing to vary with the radial dimension, (width), of the channel for enlarging the sectional area. The outer diameter of the pump casing is non-concentric because of the volute, and the axial dimensions, (depth), is not varied, further that, the total degree of the channel surrounding impeller is 360 degrees or less. The U.S. Pat. Nos. 5,234,317, 5,385,444 and 5,318,403 disclose the technology related to the pump casing structure of the channel of diffuser. Nevertheless the prior arts have not released the technology regarding the present invention.

Through many years' experience in manufacture, devoted study, continuous research, experimental analysis, and improvement, the inventor finally proposes an invention that can reasonably and effectively improve the shortcomings of the prior arts.

SUMMARY OF THE INVENTION

The main objective of the invention is to submit a creative volute channel device of a small centrifugal pump, which has the benefits of easy manufacturing, low cost and compact size.

The second objective of the invention is to submit a volute channel device, which adopts a circular casing with concentricity to decrease cost, and designs a volute channel structure whose width and depth are gradually increased by the direction of fluid flow. The total surrounding degree of the volute channel is over 360 degrees to promote pumping efficiency.

To approach above objectives, a preferred embodiment of the volute channel device of the present invention accepts a special volute device and a throat partition to be contained in a circular casing. The volute channel device is figured as spiral to surround the exit of the impeller. Based on the direction of pumping fluid, there is a water-cut angle on the leading edge of the spiral volute channel, and the volute channel is gradually wider and deeper since the water-cut angle to enlarge the cross-section of the volute channel. The outer diameter of the volute channel is almost concentric to the inner diameter of the circular casing. The throat partition connects to the rear edge of the volute channel and extends toward the exit of the casing so as to that the throat partition is at least a partial extension of the volute channel; further, due to the extended volute channel of the throat partition overlaps with the leading edge of the volute channel structure, the total degree, surrounding the exit of the impeller, of the volute channel is over 360 degrees. Because of the circular casing, simple volute channel and throat partition, to form aforesaid structures via stamping or casting is easy and saving cost. Besides, the surrounding degree of the volute channel with increasing width and depth is in excess of 360 degrees, and cooperates with the design of the water-cut angle to ensure a better pumping efficiency but without increasing the outer diameter and height of casing.

Preferably, the position of the throat partition corresponds to the exit of the casing so as to that the exit is at the outlet of the throat partition and at the circular casing. It is to limit the fluid around the throat partition and is guided to the exit of the casing.

Preferably, the water-cut angle on the leading edge of the channel bottom plate protrudes out of the top plate and closes further to the exit of the impeller. This is not only the degree being increased, but also the height being added for better water-cut efficiency.

Preferably, there is not only one protruding hole on the channel toward the inlet of the impeller for promoting the self-priming function, by returning the high head fluid from pump outlet.

For your esteemed members of reviewing committee to further understand and recognized the structural objective and function of the invention, a detailed description incorporated with drawings is presented as follows.

DETAILED DESCRIPTION OF THE INVENTION

Figure 1:
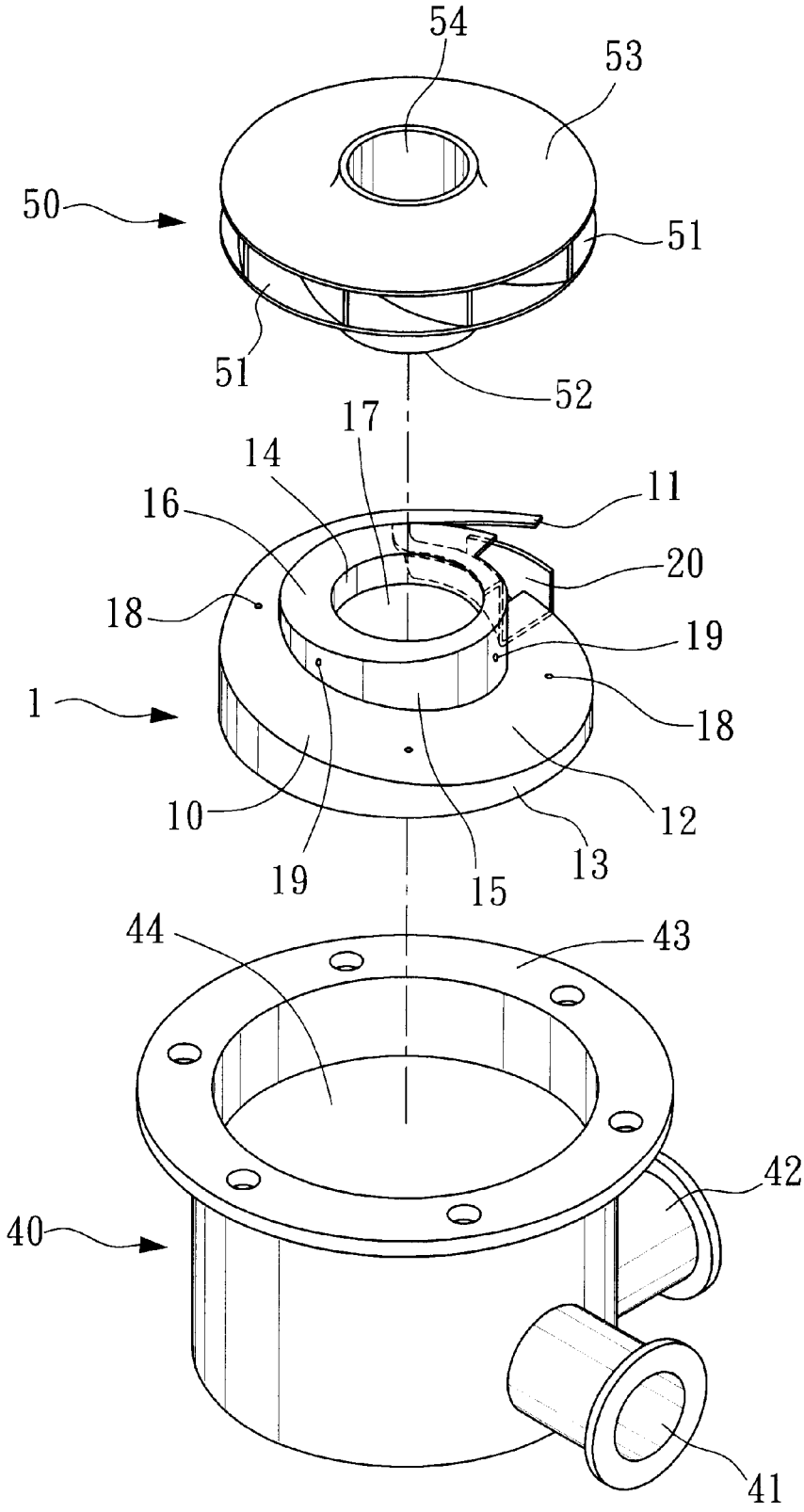
FIG. 1 is a 3-D dimensional view of a first preferred embodiment of a volute channel device of a pump for the present invention.

The major idea for a volute channel device 1 of the present invention is to design a special volute channel structure 10 and a throat partition 20 for a circular casing 40 containing both of the volute channel structure 10 and the throat partition 20. The volute channel structure 10 is a spiral volute channel and surrounds an impeller exit side 51 of an impeller 50. According to the direction of pumping fluid, a water-cut angle 11 is on a leading edge of the spiral volute channel, and the volute channel is gradually wider and deeper since the water-cut angle 11; besides, an outer diameter of the volute channel is about the same concentric state as an inner diameter of the circular casing 40. The throat partition 20 connects to a rear edge of the volute channel and extends toward an exit 41 of the casing 40 so as to that throat partition 20 can be at least an extension of the volute channel; further that the extension from throat partition 20 overlaps a front section of volute channel structure 10, and it makes that the total degree for surrounding the impeller exit side 51 is over 360 degrees. Due to casing 40 being as a cylinder and the simple structures of volute channel structure 10 and throat structure 20, to manufacture them via stamping or casting may be relatively easier and lower. Additionally, since the volute channel being gradually wider and deeper and its total surrounding degree being over 360 degrees, and the cooperation of the volute channel and the water-cut angle 11, the present invention surely has a better pumping efficiency, but an outer diameter and a height of casing 40 are not increased comparatively, so the present invention totally corresponds to the needs in current.

Following will be some preferred embodiments with illustrations for more detail of structures, actions and functions of volute channel device 1.

Figure 3:
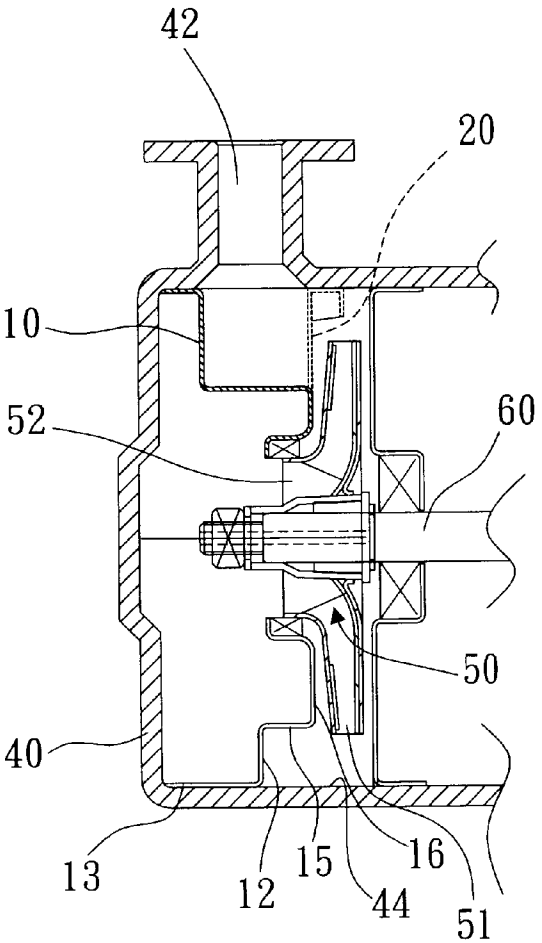
FIG. 3 is a sectional view of the volute channel device and the impeller with other parts in a casing of the first preferred embodiment of the present invention.
Figure 2:
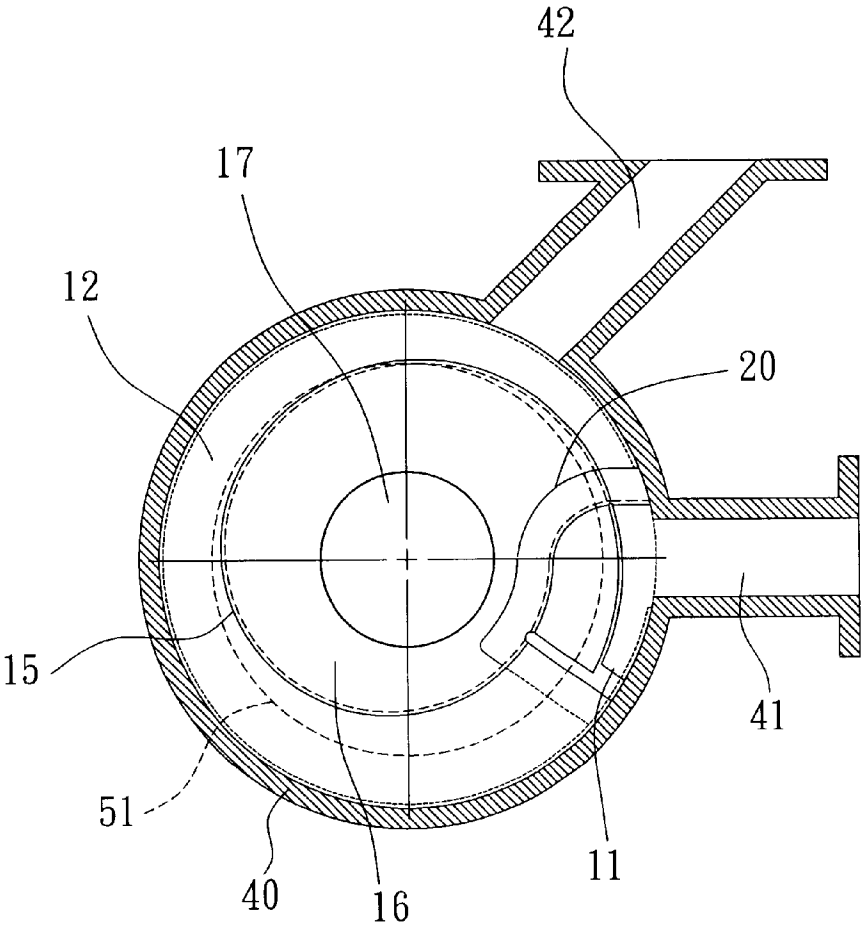
FIG. 2 is a top view of the volute channel device of the first preferred embodiment of the present invention. (dot lines representing an impeller)
Figure 4:
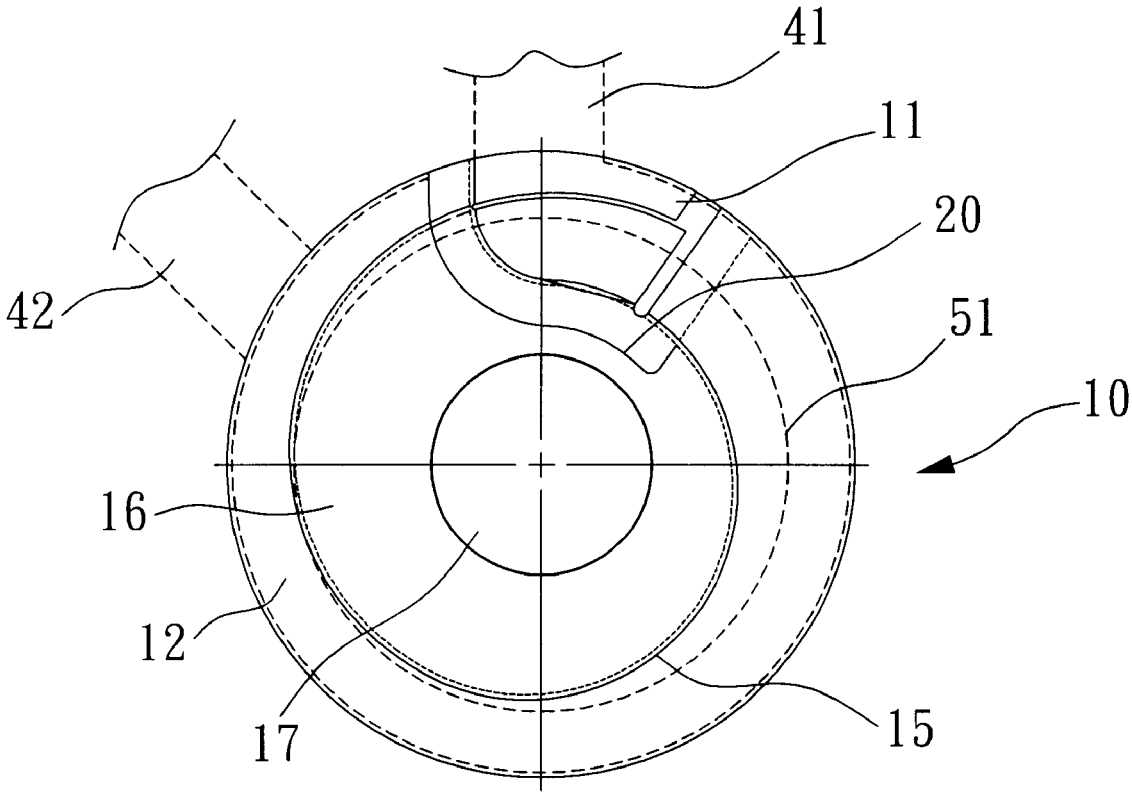
FIG. 4 is a sketch of a volute channel structure and a throat partition structure of the volute channel device of the first preferred embodiment of the present invention.
Figure 5:
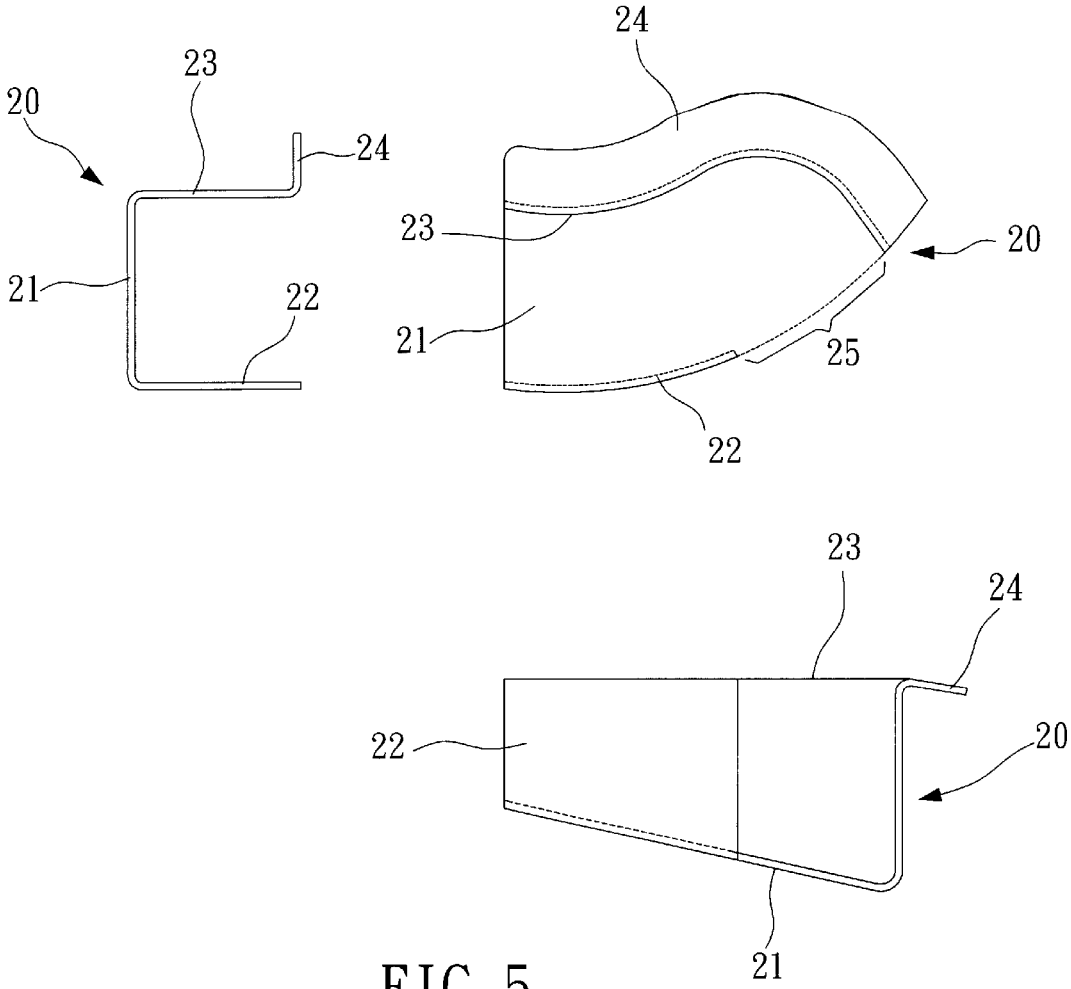
FIG. 5 is a complete view of the throat partition structure of the volute channel device of the first preferred embodiment of the present invention.
Figure 6:
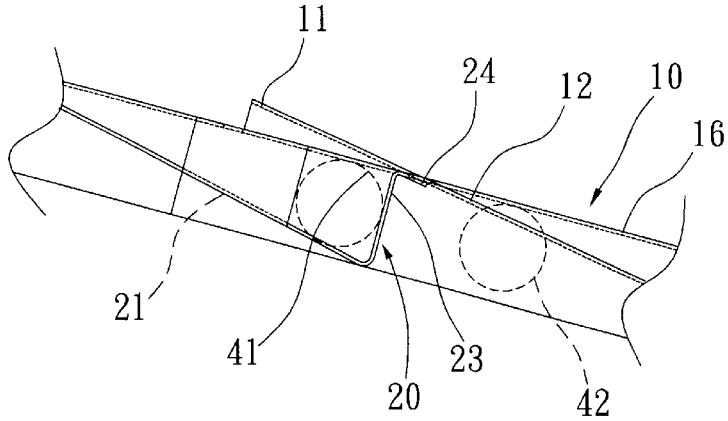
FIG. 6 is a sketch of relative positions of the throat partition, a water-cut in the volute channel structure, an inlet and an exit in the casing of the first preferred embodiment of the present invention.
Figure 7:
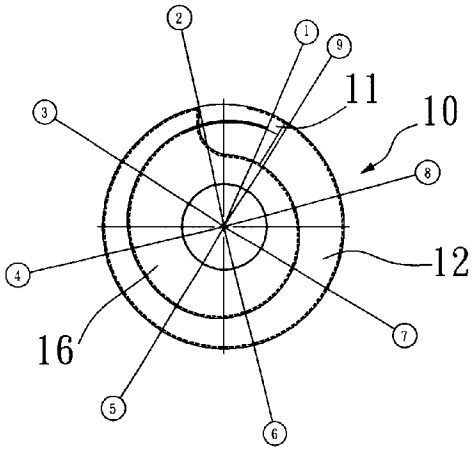
FIG. 7 is a sketch of sectional positions of different portions of the volute channel of the volute channel structure of the first preferred embodiment of the present invention.
Figure 8:
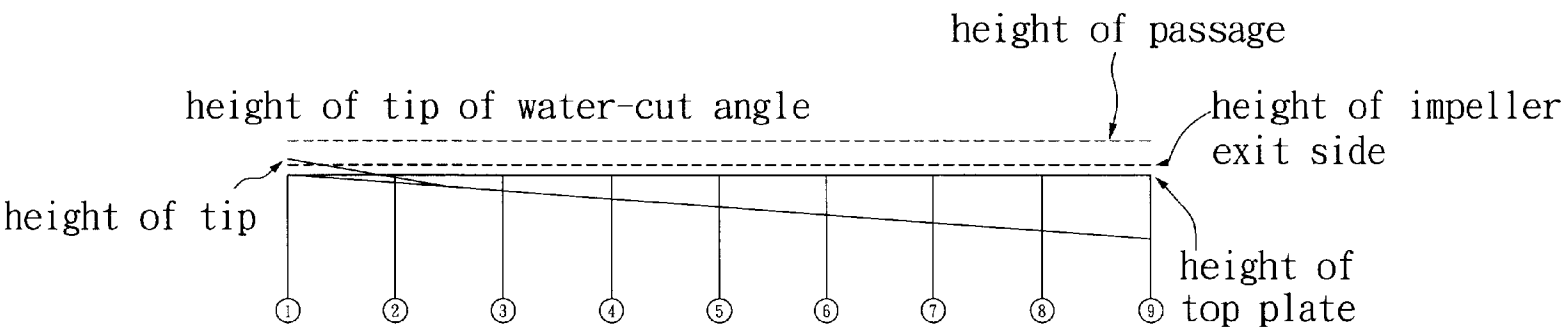
FIG. 8 is a sketch of channel depth variations of sectional positions of different portions of the volute channel of the first preferred embodiment of the present invention.
Figure 9:
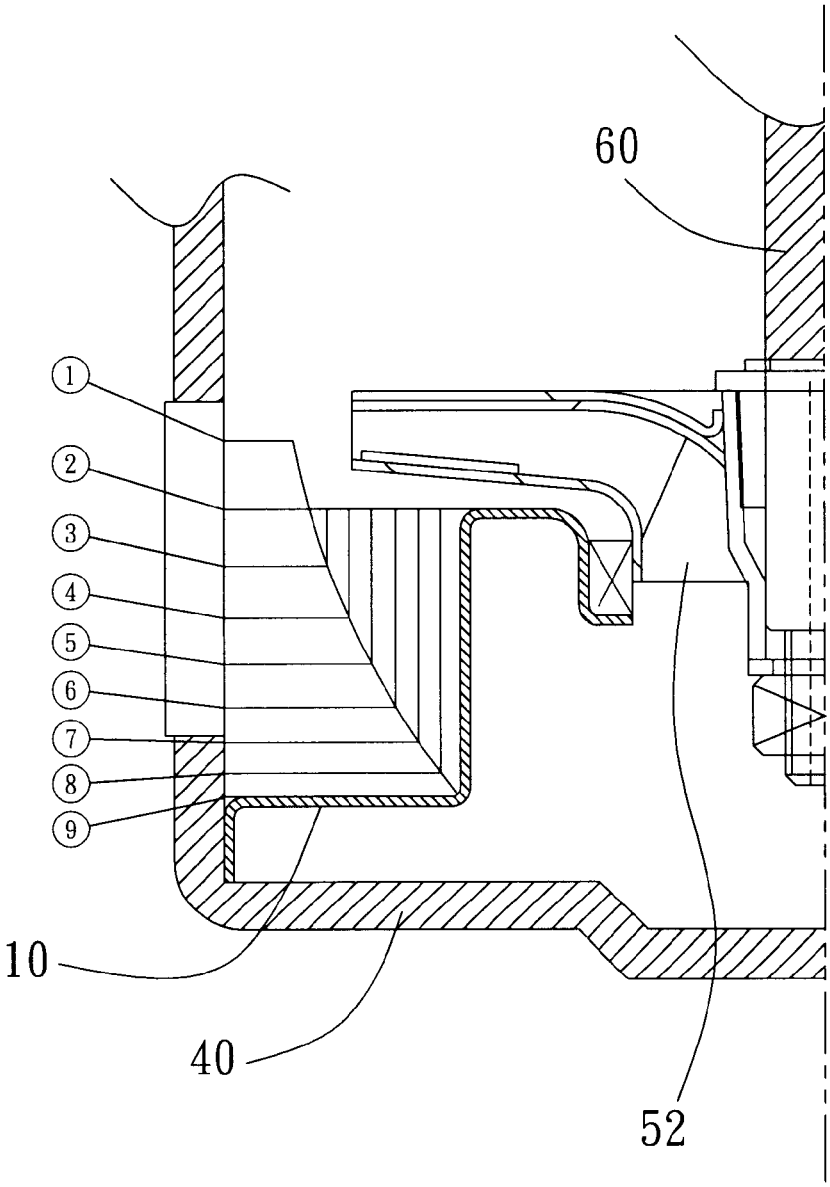
FIG. 9 is a sketch of sectional area variations of sectional positions of different portions of the volute channel of the volute channel device of the first preferred embodiment of the present invention.

Please refer to FIGS. 1 to 9, which is a first preferred embodiment of volute channel device 1 of the present invention. Wherein, FIG. 1 is a 3-D dimensional view of a first preferred embodiment of volute channel device 1 of a pump for the present invention. FIG. 2 is a top view of volute channel device 1 (dot lines representing an impeller). FIG. 3 is a sectional view of volute channel device 1 and the impeller 50 with other parts in the casing 40. FIG. 4 is a sketch of the volute channel structure 10 and the throat partition structure 20 of volute channel device 1. FIG. 5 is a complete view of the throat partition structure 20. FIG. 6 is a sketch of relative positions of the throat partition 20, the water-cut 11 in the volute channel structure 10, an inlet 42 and an exit 41 in the casing 40. FIG. 7 is a sketch of sectional positions of different portions of the volute channel of the volute channel structure of the first preferred embodiment of the present invention. FIG. 8 is a sketch of channel depth variations of sectional positions of different portions of the volute channel. FIG. 9 is a sketch of sectional area variations of sectional positions of different portions of the volute channel of volute channel device 1.

As shown from FIG. 1 FIG. 6, volute channel device 1 is contained in the circular casing 40 with cylindrical figure, and volute channel device 1 cooperates with the concentric rotational impeller 50 to deliver fluid. Impeller 50 includes the impeller exit 51, an impeller inlet 52, an impeller bottom plate 53 and an axial hole 54 for a rotational axis 60 going through; casing 40 has an exit 41, an inlet 42 and a flange 43 to combine with a motor. For the preferred embodiment, the exit 41 and the inlet 42 are inclined 45 degrees. Impeller 50 and casing 40 are not in the scope of the present invention, thus they will not be discussed any further hereinafter.

The volute channel device 1 of the present invention roughly comprises: volute channel structure 10 and throat partition 20.

The volute channel structure 10 is a spiral volute channel and surrounds the impeller exit side 51 of impeller 50. According to the direction of pumping fluid, the water-cut angle 11 is on a leading edge of the spiral volute channel, and the volute channel is gradually wider and deeper since the water-cut angle 11 for increasing sectional area of the volute channel; besides, an outer diameter of the volute channel is about the same concentric state as an inner diameter of the circular casing 40; on the other hand, an inner diameter of the volute channel is shaped as volute or spiral.

According to the view of real structure, volute channel structure 10 comprises at least: a channel bottom plate 12, an outer edge wall 13, an inner edge wall 14, a channel inner plate 15 and a top plate 16. The water-cut angle 11 is on the rear edge of the channel, bottom plate 12, and the water-cut angle 11 along a circle direction is greater an outer diameter of the impeller exit side 51 (that is, with a space to impeller out diameter); further that water-cut angle 11 extends to an above of the exit 41. The channel bottom plate 12 surrounds the impeller exit side 51 and is gradually wider and deeper to be a spiral structure; an outer rim of the channel bottom plate 12 is about the same concentric state as the inner diameter of the circular casing 40; an inner rim for the channel bottom plate 12 is figured as spiral. The outer edge wall 13 surrounds the outer rim of the channel bottom plate 12 and is on the inner sidewall 44 of the circular casing 40. The channel inner plate 15 is on the inner rim of the channel bottom plate 12 and protrudes toward impeller 50. The hollow top plate 16 is on a top of the channel inner plate 15, and a center of the top plate 16 has a hole 17 to contain impeller inlet side 52; hence impeller exit side 51 and impeller inlet side 52 can be partitioned by top plate 16, channel inner plate 15 and channel bottom plate 12. A surface of top plate 16 is perpendicular to a rotational axis direction of impeller 50. The inner rim of top plate 16 is the same center with the outer rim of channel bottom plate 12, and the inner rim is smaller than the outer rim. The inner edge wall 14 is an extension along the axial direction for the inner rim of top plate 16 so as to that the impeller inlet side 52 is contained by hole 17 surrounded the inner edge wall 14 of the inner rim of top plate 16. The outer rim of top plate 16 is formed as a spiral surrounding structure. Due to the increasing width of channel bottom plate 12, the surface width of top plate 16 may be narrower with the direction of pumping fluid. Water-cut angle 11 of the leading edge of channel bottom plate 12 protrudes out of top plate 16 and is closer to impeller exit side 51, shown as FIGS. 4 and 6, that is, the length and height both are elongated for better water-cut efficiency. The direction for channel bottom plate 12 toward impeller inlet side 52 or another direction for channel inner plate 15 toward impeller inlet side 52 can be alternatively arranged one or more small nozzle, 18 and 19 (not necessary for both), in annular located. A little of the high-pressure fluid in volute channel can return back to impeller inlet side 52 by means of the nozzles 18 and 19, therefore the inlet head of the fluid is increasing and the mixture of fluid and air around impeller inlet side 52 is better, and the mixture may enter into impeller 50 with higher speed for that pump is capable of normally delivering liquid under low NPSHA, further to increasing self-priming function and pumping efficiency. Besides, the structures of-nozzles 18 and 19 are not only with simple structures for self-priming function, but also that they can be formed via stamping or casting for saving cost and not having dimension increase.

The throat partition 20 connects to the rear edge of the volute channel and extends toward the exit 41 of the casing 40 so as to that throat partition 20 can be at least the extension of the volute channel; further that the extension from throat partition 20 overlaps the front section of volute channel structure 10, and it makes that the total degree for surrounding the impeller exit side 51 is over 360 degrees. Based on the view of real structure, a position of throat partition 20 corresponding to exit 40 of casing 40 is an arc fillister structure, and it comprises at least: a bottom partition 21, an outer partition 22, an inner partition 23 and an upper edge 24 protruded out from a top of the inner partition 23. According to the direction of pumping fluid, a leading edge of the bottom partition 21 combines with the rear edge (that is, the rear edge of channel bottom plate 12) of volute channel of volute channel structure I 0. The outer partition 22 is to join with inner sidewall 44. The inner partition 23 closes to channel inner plate 15 of volute channel structure 1. The upper edge 24 units with a surface of a lower side (back side) of top plate 16. A mutual rear edge of bottom partition 2 l, outer partition 22 and inner partition 23, the rear edge 25, is just relative to exit 41, hence exit 41 is contained around rear edge 25 and channel bottom plate 12 of volute channel. A close space is thus formed at a position of exit 41 around throat partition 20 and a front section of volute channel, and it is to force fluid moving toward exit 41. On the other hand, due to the designed water-cut angle 11 and throat partition 20, water-cut angle 11 is a little higher than impeller exit side 51 (view from axial direction) and overlaps the channel from throat partition 20. So, while the mixture of gas and liquid being rotated by impeller 50, delivered, diffused and slow down, it is continuously guided by water-cut angle 11 and throat partition 20 to exit 41 for avoiding that gas is accumulated in channel to decrease pumping efficiency.

In the preferred embodiment, volute channel structure 10 and throat partition 20 are individually made and fabricated together by welding or agglutination. For casing 40, which is made of sheet metal piece or casting piece. However, volute channel structure 10 and throat partition 20 can also be made by casting, or both are made in one body as a single piece; or the structure 10 and the partition 20 can be made in one unit except the portion water-cut angle 11 of a front portion of channel bottom plate 12; water-cut angle 11 can be manufactured in another way, and then to joint water-cut angle 11 and channel bottom plate 12 together to form volute channel device 1 of the present invention.

Referring to FIGS. 7 to 9, which separately describe different variations of volute channel device 1 of the first preferred embodiment, the different variations include sectional positions of different portions of the volute channel, channel depth variations of sectional positions of different portions and sectional area variations of sectional positions of different portions; wherein the cross-section symbols of ①, ② to ⑨ represent the sectional positions of the same position. The volute channel is gradually deeper since water-cut angle 11 along with the pumping direction. Due to the leading edge (that is, an initial point of channel) of water-cut angle 11 is between cross-section symbols ① and ⑨ and exit 41 (that is, a last point of channel) is between cross-section symbols ② and ⑨, hence the total degree of surrounding volute channel is over 360 degree. A height (that is, an axial height) of a tip of water-cut angle 11 is between a height of impeller exit side 51 and a top height of channel for better water-cut efficiency. The positions along the radial and axial (pumping direction) directions are discussed previously, they will not be described any further hereinafter.

Cross-section symbol ① whose sectional area is the smallest according to FIGS. 7 and 9, then being greater; a sectional area of cross-section symbol ⑨ is the greatest, thus a better fluid diffusion efficiency can be reached.

Along with above mention, volute channel device 1 of the present invention not only has the increasing sectional area of channel, but also with the extended and overlapped volute channel because of installing throat partition 20; that's why the total length of volute channel can surround impeller exit side 51 over 360 degrees. So, comparing to "the concentric circle", "equivalent sectional area" and "the surrounding channel not approaching 360 degrees" in prior arts, the present invention obviously has a better diffusion function. Because of the circular casing 40, simple volute channel structure 10 and throat partition 20, to form aforesaid structures via stamping or casting is easy and saving cost; on the contrary, prior arts may use special technologies to manufacture the pump casing with variable outer diameters; further, according to the prior art of adding diffusers, the cost and the dimensions for the present invention are apparently better than ever. Besides, firstly the length of the surrounding volute channel is able to approach surrounding angle more than 360 degrees, and secondly adding the water-cut angle 10, thus the present invention ensures that a better pumping, efficiency is reached, but without adding the dimensions of outer diameter and axial length; hence, the present invention absolutely conform to the marketing needs of small centrifugal pump.

Following is other preferred embodiments. Because most of the components are same as the first preferred embodiment, thus the same components will be given the same numbers, and without further description for structure.

Figure 10:
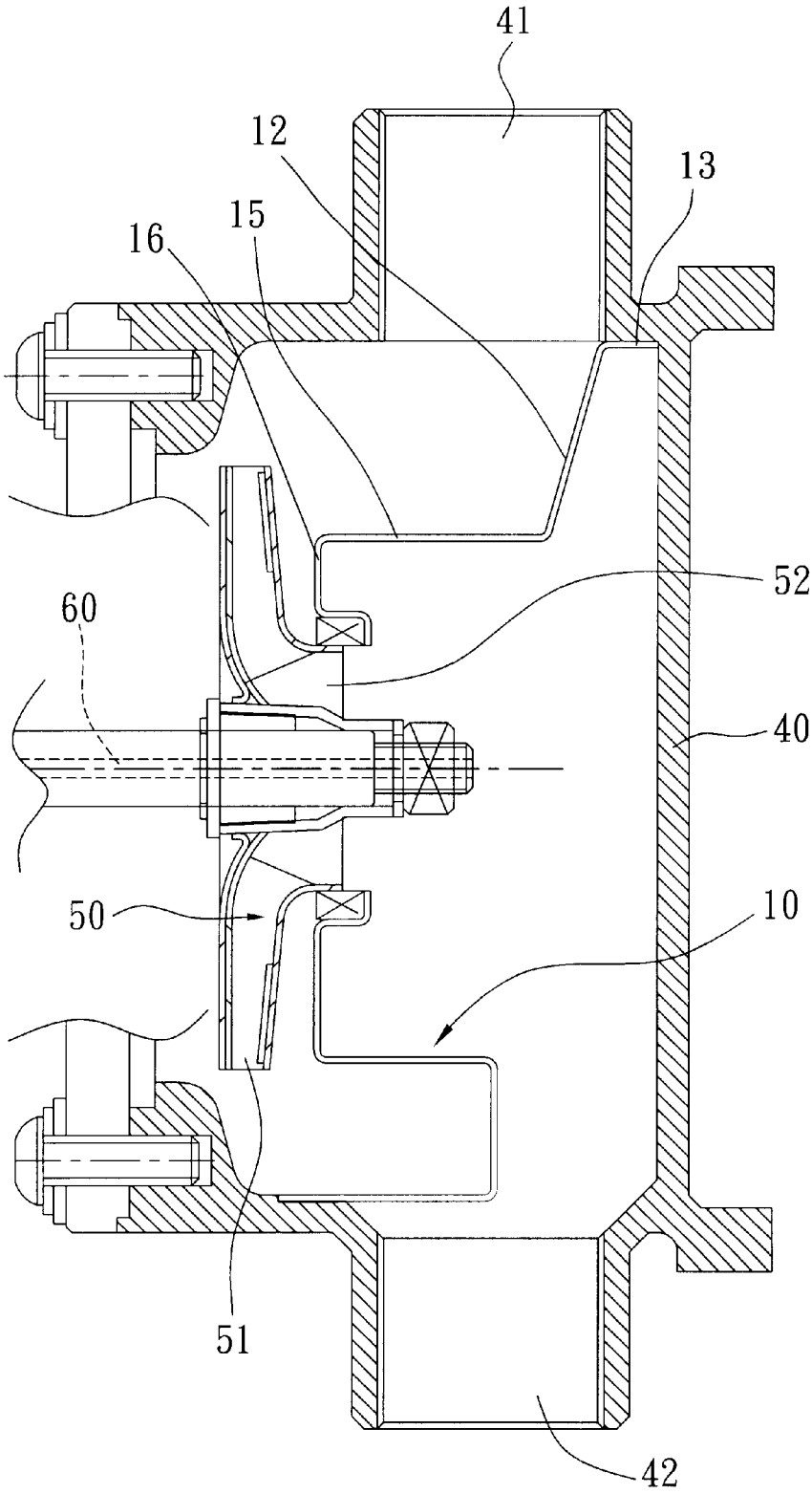
FIG. 10 is a sectional view of a second preferred embodiment of the volute channel device of the present invention.

Referring to FIG. 10, which is a sectional view of a second preferred embodiment of the volute channel device of the present invention. The most components and structures in FIG. 10 are similar to the embodiment in FIGS. 1 and 3. The only difference is that exit 41 and inlet 42 of casing 40 are arranged as a line, that is, 180 degrees. Continuously, the position of water-cut angle 11 of volute channel structure 10 and the dimensions of volute channel structure 10 may be revised. Channel bottom plate 12 around exit 41 is inclined (downward toward outer diameter). Throat partition is not independently manufactured, and it is constructed with volute channel structure in one body.

Figure 11:
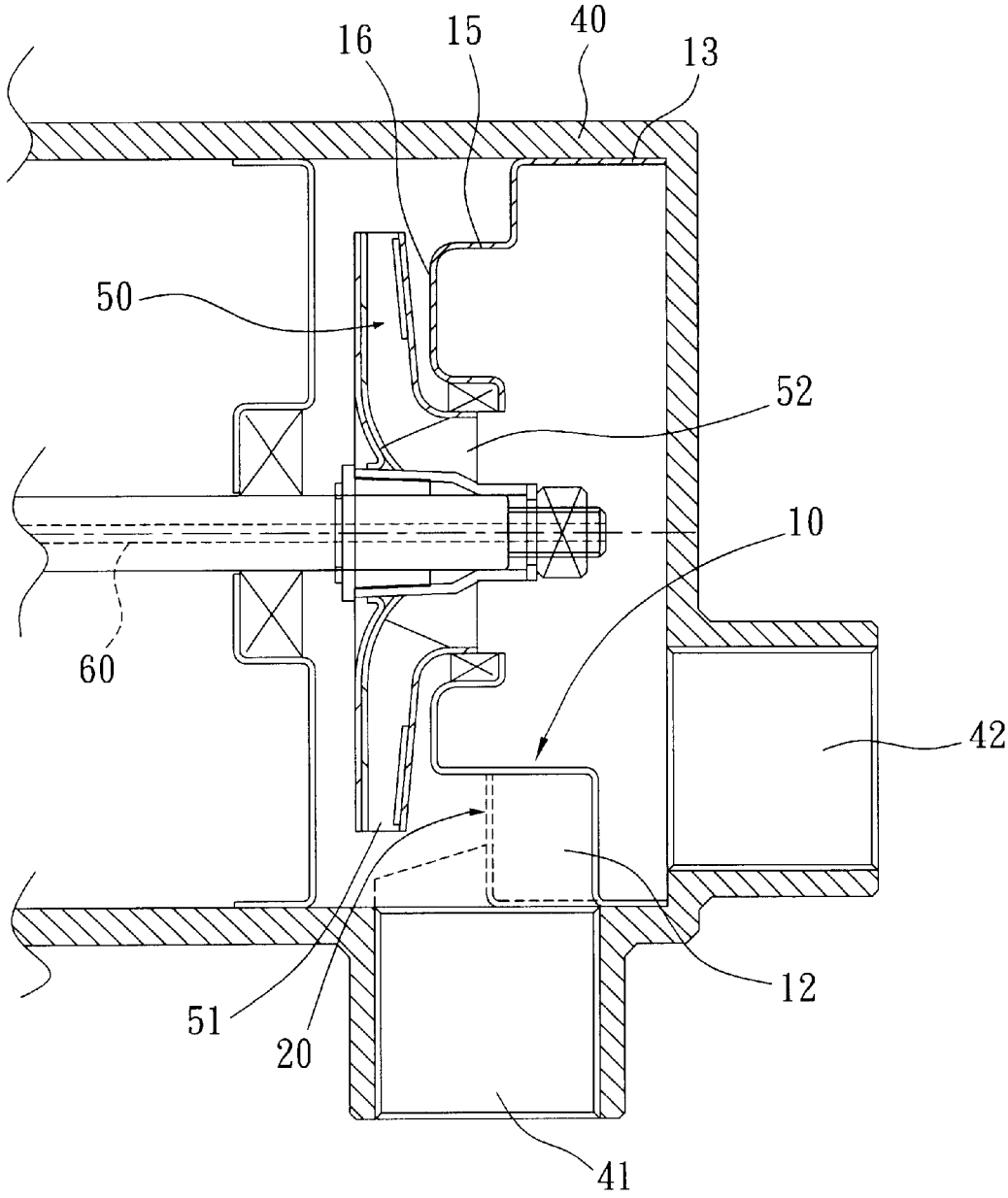
FIG. 11 is a sectional view of a third preferred embodiment of the volute channel device of the present invention.

Referring to FIG. 11, which is a sectional view of a third preferred embodiment of the volute channel device of the present invention. The most components and structures in FIG. 11 are similar to the embodiment in FIGS. 1 and 3. The only difference is that exit 41 and inlet 42 of casing 40 is vertical and end suction at up side of the casing arrangement. Continuously, the position of water-cut angle 11 of volute channel structure 10 and the throat partition 20 may be revised. Although exit 41 shown in the figure is toward down, it is just a different view than a view in real operation, and the view of the real operation actually shows that exit 41 is toward up.

Figure 12:
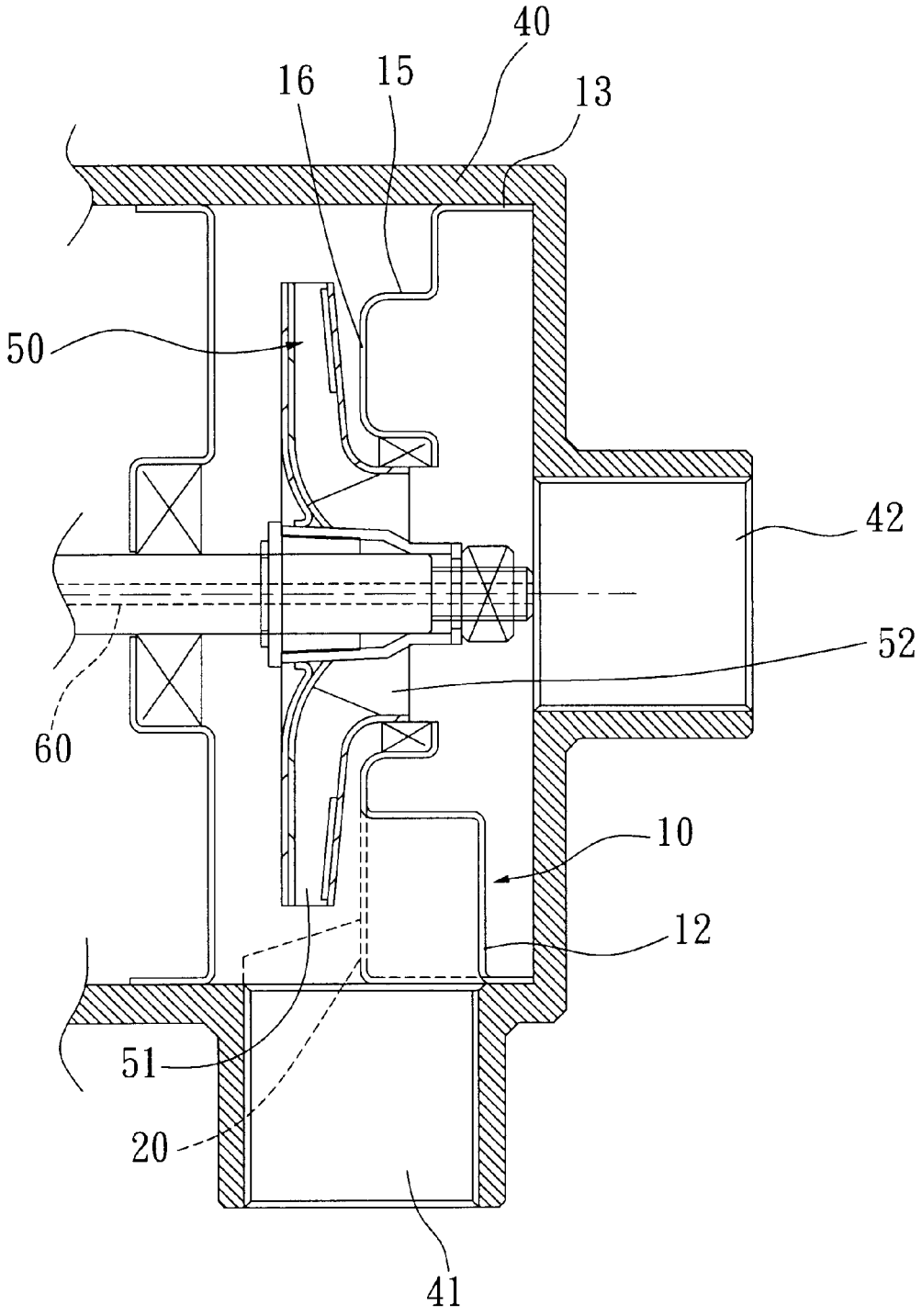
FIG. 12 is a sectional view of a fourth preferred embodiment of the volute channel device of the present invention.

Referring to FIG. 12, which is a sectional view of a fourth preferred embodiment of the volute channel device of the present invention. The most components and structures in FIG. 12 are similar to the embodiment in FIGS. 1 and 3. The only difference is that exit 41 and inlet 42 of casing 40 is vertical and center end suction arrangement; further that, inlet 42 has a concentric axis with impeller inlet side 52. Continuously, the position of water-cut angle 11 of volute channel structure 10 and the throat partition 20 may be revised. Although exit 41 shown in the figure is toward down, it is just a different view than a view in real operation, and the view of the real operation actually shows that exit 41 is toward up.

Figure 13:
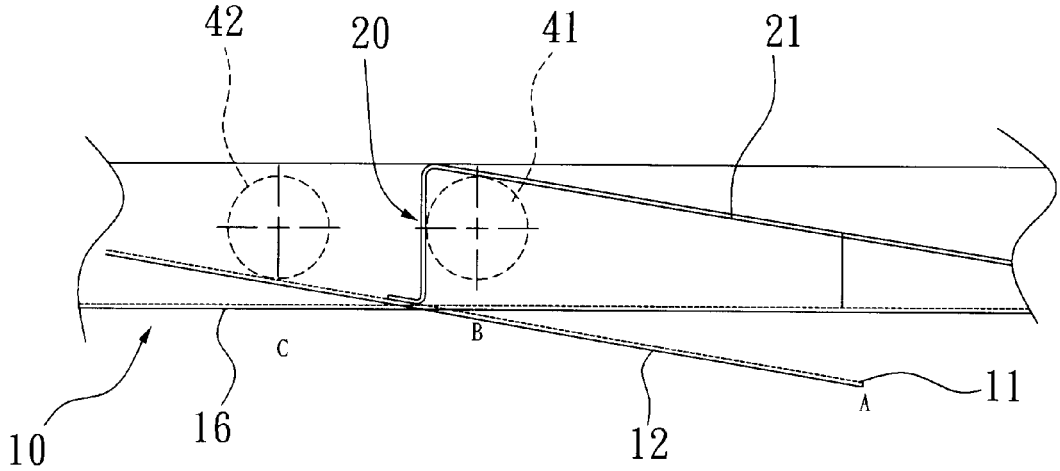
FIG. 13 is a sectional view of a fifth preferred embodiment of the volute channel device of the present invention, which represents an assembly relationship of the volute channel structure and the throat partition structure and a relative position relationship of the throat partition, the water-cut angle of the volute channel structure, the inlet and the exit of the casing.
Figure 13:
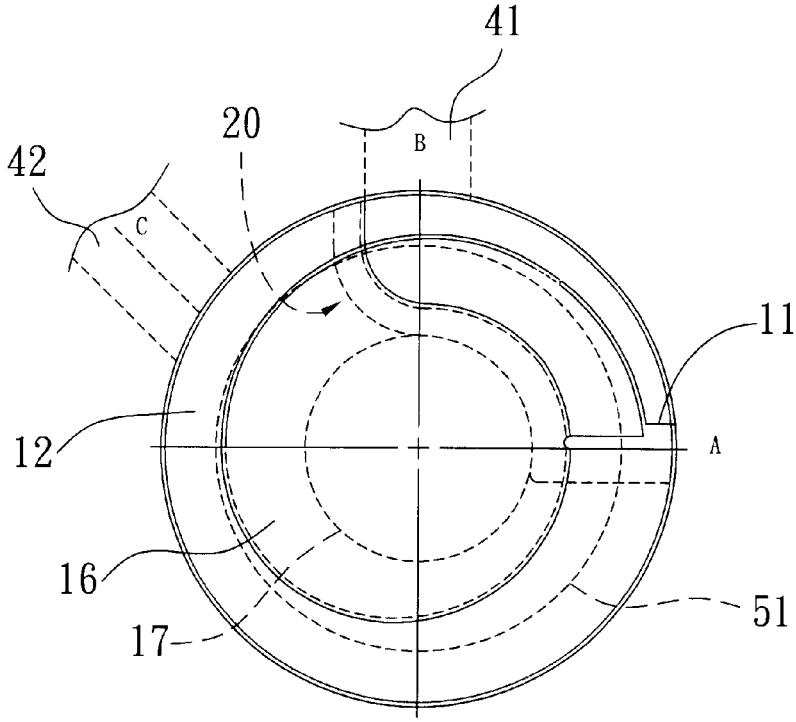
Figure 14:
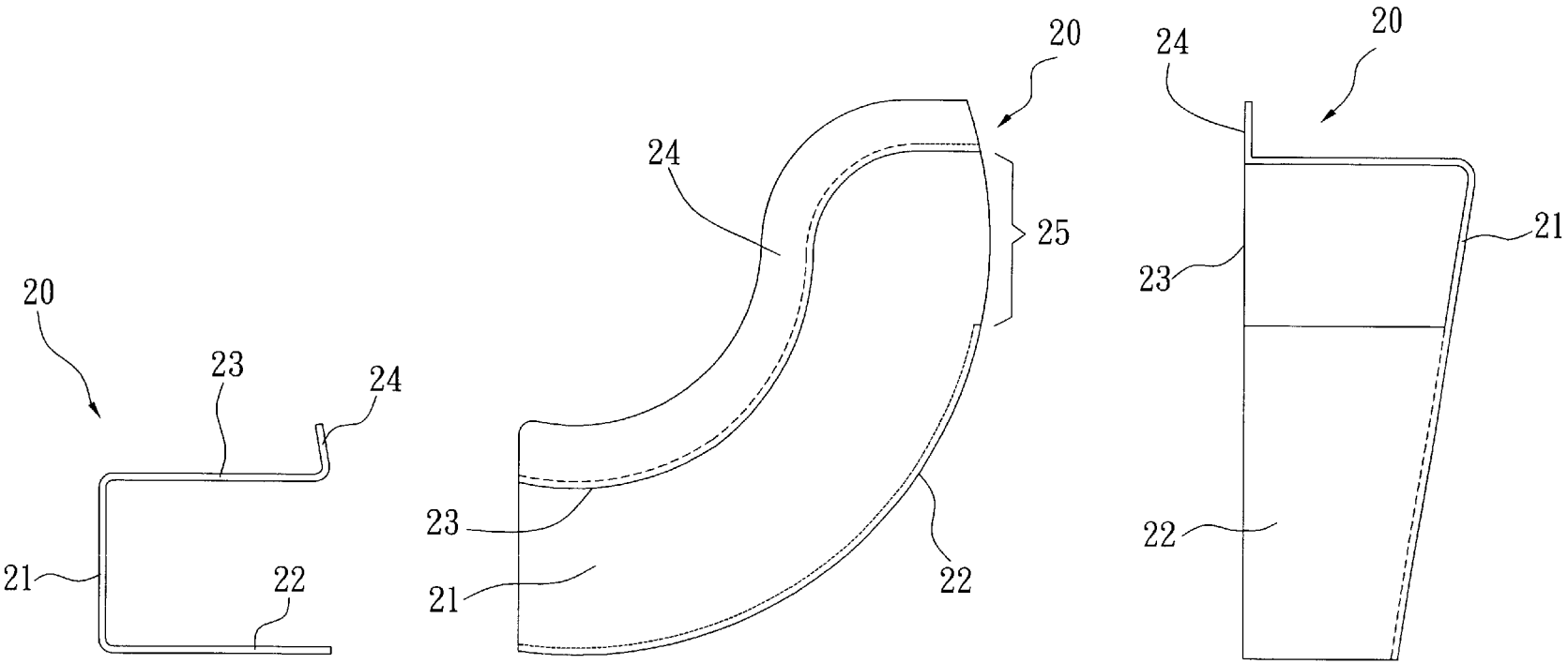
FIG. 14 is a complete view of the throat partition structure of the fourth preferred embodiment of the volute channel device of the present invention.

Referring to FIGS. 13 and 14, which are sketches of a fifth embodiment of the volute channel device of the present invention. The most components and structures in FIG. 13 are similar to the embodiment in FIGS. 1 and 3. The only difference is that the water-cut angle 11 (that is, a front section of channel bottom plate 12) of FIGS. 13 and 14 is extended much longer, and the dimension of throat partition 20 is relative longer as well. That is, the total length of channel is longer so as to have more space to separate the gas and water in the exit channel, and prevent the gas stay in the volute channel, a better self-priming pumping efficiency.

Above description is the preferable embodiments according to the invention; however, the claimed fields of the invention are not restricted to the embodiments shown in the invention, but any variation made according to the contents of the invention, the generated function and the characteristic that are similar to the embodiment of the invention, and the concepts conceivable by those who are skilled in such arts are all belonged to the claimed fields of the invention.

In summary, the improved structure for centrifugal pumps according to the invention has the characteristics of simple structure, easy manufacture and assembly. Not only may the shortcomings in the prior structure—poor endurance caused by inferior design of parts and even the influential smoothness of operation—be indeed improved, but also had the invention never seen in any journal or public occasion before application, such that the practicality of the invention is thereby without doubt and the merits regulated in the patent law are indeed fulfilled, so the application of this novel patent is thus proposed and, please your esteemed members of reviewing committee take time to review this application in a favorable way and grant it as a normal patent as soon as possible.

What is claimed is:

1. A device of a volute channel of a pump, which contained in a circular casing and cooperating with a rotational impeller of a concentric device to pump and deliver fluid, the impeller having an impeller inlet side and an impeller exit side, an inlet and an exit for fluid on the casing, the device comprising:

a volute channel structure being a spiral volute channel and surrounding the impeller exit side, depending on a direction of pumping fluid, a leading edge of the spiral volute channel having a water-cut angle, the volute channel being wider and deeper from the water-cut angle to gradually have an enlarged sectional area of the volute channel, an outer diameter of the volute channel being about concentric state with an inner diameter of the circular casing; and a throat partition connecting to a rear edge of the volute channel and extending toward the exit of the casing for that the throat partition being at least part of extension of the volute channel, the extension of the volute channel overlapping the leading edge of the volute channel to have a total length of the volute channel, the total length being able to surround the impeller exit side over 360 degrees.

2. The device of the volute channel of the pump as cited in claim 1, wherein a position of the throat partition corresponds to the exit of the casing, and it is to limit fluid around the throat partition and the leading edge of the volute channel, and thus the fluid is guided to the exit of the casing.

3. The device of the volute channel of the pump as cited in claim 2, wherein the throat partition is an arc fillister structure, and it comprises at least: a bottom partition, an outer partition, and an inner partition, according to the direction of pumping fluid, a leading edge of the bottom partition combines with the rear edge of the volute channel of the volute channel structure, the outer partition is to join with the casing, the inner partition becomes a member of the volute channel structure; further, the rear edge of the bottom partition, the outer partition and the inner partition is just corresponding to the exit, and the exit is contained among the rear edge of the bottom partition, the outer partition and the inner partition and the leading edge of the volute channel.

4. The device of the volute channel of the pump as cited in claim 3, wherein the throat partition has an upper edge extended from a top of the inner partition.

5. The device of the volute channel of the pump as cited in claim 1, wherein the volute channel structure at least comprises:

a channel bottom plate, whose leading edge has the water-cut angle, the channel bottom plate surrounds the impeller exit side and is gradually wider and deeper to be a spiral structure; an outer rim of the channel bottom plate is about the same concentric state as the inner diameter of the circular casing;

an outer edge wall, which surrounds the outer rim of the channel bottom plate and is on an inner sidewall of the circular casing;

a channel inner plate, which is on an inner rim of the channel bottom plate and protruded toward the impeller;

a hollow top plate, which is on a top of the channel inner plate, and a center of the top plate has a hole to contain the impeller inlet side; hence impeller exit side and impeller inlet side can be partitioned by the top plate, channel inner plate and channel bottom plate, a surface of the top plate is perpendicular to a rotational axis direction of the impeller, the inner rim of the top plate has a same center with the outer rim of channel bottom plate, and the inner rim is smaller than the outer rim, the outer rim of the top plate is formed as a spiral surrounding structure; due to the increasing width of the channel bottom plate, the surface width of the top plate may be narrower with the direction of pumping fluid.

6. The device of the volute channel of the pump as cited in claim 5, wherein the water-cut angle of the leading edge of the channel bottom plate protrudes out of the surface of the top plate and is closer to the impeller exit side.

7. The device of the volute channel of the pump as cited in claim 6, wherein the water-cut angle of the leading edge of the channel bottom plate protruding out of the surface of the top plate is not only that a length of the water-cut angle is longer, but also a height is higher.

8. The device of the volute channel of the pump as cited in claim 5, wherein at least one penetrating nozzle is set on the channel bottom plate toward the impeller inlet side.

9. The device of the volute channel of the pump as cited in claim 5, wherein at least one penetrating nozzle is set on the channel inner plate toward the impeller inlet side.

10. The device of the volute channel of the pump as cited in claim 1, wherein the throat partition is constructed with the volute channel structure in one body via stamping.

11. A device of a volute channel of a pump, which contained in a circular casing and cooperating with a rotational impeller of a concentric device to pump and deliver fluid, the impeller having an impeller inlet side and an impeller exit side, an inlet and an exit for fluid on the casing, the device comprising:

a volute channel structure at least having:

a channel bottom plate having a water-cut angle according to a direction of pumping fluid, the water-cut angle being on a leading edge of the channel bottom plate, the channel bottom plate surrounding an impeller exit side and being wider and deeper to form a spiral structure with different heights and widths; further, an outer rim of the channel bottom plate being about same concentric state with an inner diameter of the circular casing;

an outer edge wall surrounding the outer rim of the channel bottom plate and being on an inner sidewall of the circular casing;

a channel inner plate being on an inner rim of the channel bottom plate and protruding toward the impeller;

a hollow top plate being on a top of the channel inner plate, and a center of the top plate having a hole to contain the impeller inlet side; hence impeller exit side and impeller inlet side being partitioned by the top plate, channel inner plate and channel bottom plate, a surface of the top plate being perpendicular to a rotational axis direction of the impeller, the inner rim of the top plate having a same center with the outer rim of channel bottom plate, and the inner rim being smaller than the outer rim, the outer rim of the top plate being formed as a spiral surrounding structure; due to the increasing width of the channel bottom plate, the surface width of the top plate being narrower with the direction of pumping fluid; and a throat partition being an arc fillister structure and comprising at least:

a bottom partition, an outer partition, and an inner partition, according to the direction of pumping fluid, a leading edge of the bottom partition combining with the rear edge of the channel bottom plate, the outer partition joining with an inner side wall of the casing, the inner partition becoming a member of the channel inner plate; further, the rear edge of the bottom partition, the outer partition and the inner partition just corresponding to the exit, and the exit contained among the rear edge of the bottom partition, the outer partition and the inner partition and the leading edge of the channel bottom plate.

12. The device of the volute channel of the pump as cited in claim 11, wherein a space constructed by the channel bottom plate, the channel inner plate and the inner sidewall of the casing is a spiral volute channel with a gradually wider and deeper sectional area.

13. The device of the volute channel of the pump as cited in claim 12, wherein the bottom partition of the throat partition connects to the rear edge of the channel bottom plate for a total degree of the bottom partition and the channel bottom surrounding the impeller exit side being over 360 degrees.

14. The device of the volute channel of the pump as cited in claim 12, wherein the water-cut angle of the leading edge of the channel bottom plate protrudes a top of the top plate and is closer to the impeller exit side.

15. The device of the volute channel of the pump as cited in claim, wherein the water-cut angle of the leading edge of the channel bottom plate protruding out of the surface of the top plate is not only that a length of the water-cut angle is longer, but also a height is higher.

16. The device of the volute channel of the pump as cited in claim 11, wherein a further extension of the throat partition from a top of the inner partition is an upper edge.

17. The device of the volute channel of the pump as cited in claim 11, wherein at least one penetrating nozzle is set on the channel bottom plate toward the impeller inlet side.

18. The device of the volute channel of the pump as cited in claim 11 wherein at least one penetrating nozzle is set on the channel inner plate toward the impeller inlet side.

19. The device of the volute channel of the pump as cited in claim 11, wherein the throat partition is constructed with the volute channel structure in one body via stamping.

20. A casing set with a spiral volute channel comprising:

a circular casing having a space and an inner sidewall, an inlet and an exit for fluid being on the casing;

an impeller being contained in the space of the casing and defined a direction of a rotational axis, the impeller being driven for pumping and delivering fluid and have an impeller inlet side and an impeller exit side;

a volute channel device being mounted and position in the space of the casing, the device having a spiral volute channel surrounding the impeller exit side, according a direction of pumping fluid, a leading edge of the spiral volute channel having a gradually wider and deeper sectional area of the volute channel; an outer diameter of the volute channel being about same concentric state with an inner diameter of the casing; a total length of the volute channel being able to surround the impeller exit side bovver 360 degrees.

21. The casing set with the spiral volute channel as cited in claim 20, wherein the volute channel device further comprises a volute channel structure and a throat structure, the volute channel structure is a major part of constructing the spiral volute channel, according to the direction of pumping fluid, the throat partition connects to a rear edge of the volute channel and extends toward the exit so as to that the throat partition is at least and mainly an extension of the volute channel; the extension of the volute channel overlaps the leading edge of the volute channel to have the total length of the volute channel, the total length is able to surround the impeller exit side over 360 degrees.

22. The casing set with the spiral volute channel as cited in claim 20, wherein a plurality of penetrating nozzles are on the volute channel device toward the impeller inlet side.

* * * * *